US007794275B2

(12) United States Patent
Rodrigues

(10) Patent No.: US 7,794,275 B2
(45) Date of Patent: Sep. 14, 2010

(54) COAXIAL CABLE CONNECTOR WITH INNER SLEEVE RING

(75) Inventor: Julio Filipe Rodrigues, Collierville, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 295 days.

(21) Appl. No.: 12/077,413

(22) Filed: Mar. 19, 2008

(65) Prior Publication Data

US 2008/0274644 A1 Nov. 6, 2008

Related U.S. Application Data

(60) Provisional application No. 60/926,986, filed on May 1, 2007.

(51) Int. Cl.
*H01R 9/05* (2006.01)

(52) U.S. Cl. ..... 439/584

(58) Field of Classification Search ..... 439/578, 439/583, 584

See application file for complete search history.

(56) References Cited

U.S. PATENT DOCUMENTS

| | | | |
|---|---|---|---|
| 1,667,485 | A | 4/1928 | MacDonald |
| 2,258,737 | A | 10/1941 | Browne |
| 2,544,654 | A | 3/1951 | Brown |
| 2,549,647 | A | 4/1951 | Turenne |
| 3,184,706 | A | 5/1965 | Atkins |
| 3,275,913 | A | 9/1966 | Blanchard et al. |
| 3,292,136 | A | 12/1966 | Somerset |
| 3,350,677 | A | 10/1967 | Daum |
| 3,355,698 | A | 11/1967 | Keller |
| 3,373,243 | A | 3/1968 | Janowiak et al. |
| 3,406,373 | A | 10/1968 | Forney, Jr. |
| 3,448,430 | A | 6/1969 | Kelly |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |

(Continued)

FOREIGN PATENT DOCUMENTS

DE 47931 10/1888

(Continued)

OTHER PUBLICATIONS

Sell Sheet from Stirling; www.StirlingUSA.com; Reader Service No. 109; regarding SPL-6-RTQ 3-In-One RTQ Connectors.

(Continued)

*Primary Examiner*—James Harvey
(74) *Attorney, Agent, or Firm*—Hoffman & Baron, LLP

(57) ABSTRACT

A coaxial cable connector includes a connector body having a rearward cable receiving end, a locking sleeve movably coupled to the rearward cable receiving end of the connector body and a sleeve ring movably disposed within a rearward sleeve ring receiving end of the locking sleeve. The sleeve ring has a forward end for retaining a cable within the connector upon forward insertion of the sleeve ring within the locking sleeve. The connector further preferably includes an annular post disposed within the connector body, wherein the forward end of the sleeve ring urges the cable against the post upon forward insertion of the sleeve ring within the locking sleeve.

24 Claims, 9 Drawing Sheets

U.S. PATENT DOCUMENTS

| | | | |
|---|---|---|---|
| 3,544,705 | A | 12/1970 | Winston |
| 3,564,487 | A | 2/1971 | Upstone et al. |
| 3,629,792 | A | 12/1971 | Dorrell |
| 3,633,150 | A | 1/1972 | Swartz |
| 3,668,612 | A | 6/1972 | Nepovim |
| 3,671,922 | A | 6/1972 | Zerlin et al. |
| 3,694,792 | A | 9/1972 | Wallo |
| 3,710,005 | A | 1/1973 | French |
| 3,778,535 | A | 12/1973 | Forney, Jr. |
| 3,781,762 | A | 12/1973 | Quackenbush |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,879,102 | A | 4/1975 | Horak |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,963,320 | A | 6/1976 | Spinner |
| 3,976,352 | A | 8/1976 | Spinner |
| 3,980,805 | A | 9/1976 | Lipari |
| 3,985,418 | A | 10/1976 | Spinner |
| 4,046,451 | A | 9/1977 | Juds et al. |
| 4,053,200 | A | 10/1977 | Pugner |
| 4,059,330 | A | 11/1977 | Shirey |
| 4,093,335 | A | 6/1978 | Schwartz et al. |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,156,554 | A | 5/1979 | Aujla |
| 4,165,554 | A | 8/1979 | Faget |
| 4,168,921 | A | 9/1979 | Blanchard |
| 4,225,162 | A | 9/1980 | Dola |
| 4,227,765 | A | 10/1980 | Neumann et al. |
| 4,250,348 | A | 2/1981 | Kitagawa |
| 4,280,749 | A | 7/1981 | Hemmer |
| 4,339,166 | A | 7/1982 | Dayton |
| 4,346,958 | A | 8/1982 | Blanchard |
| 4,354,721 | A | 10/1982 | Luzzi |
| 4,373,767 | A | 2/1983 | Cairns |
| 4,400,050 | A | 8/1983 | Hayward |
| 4,408,821 | A | 10/1983 | Forney, Jr. |
| 4,408,822 | A | 10/1983 | Nikitas |
| 4,421,377 | A | 12/1983 | Spinner |
| 4,444,453 | A | 4/1984 | Kirby et al. |
| 4,456,323 | A | 6/1984 | Pitcher et al. |
| 4,484,792 | A | 11/1984 | Tengler et al. |
| 4,515,427 | A | 5/1985 | Smit |
| 4,533,191 | A | 8/1985 | Blackwood |
| 4,540,231 | A | 9/1985 | Forney, Jr. |
| 4,545,637 | A | 10/1985 | Bosshard et al. |
| 4,575,274 | A | 3/1986 | Hayward |
| 4,583,811 | A | 4/1986 | McMills |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,614,390 | A | 9/1986 | Baker |
| 4,632,487 | A | 12/1986 | Wargula |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,660,921 | A | 4/1987 | Hauver |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,688,876 | A | 8/1987 | Morelli |
| 4,688,878 | A | 8/1987 | Cohen et al. |
| 4,691,976 | A | 9/1987 | Cowen |
| 4,703,987 | A | 11/1987 | Gallusser et al. |
| 4,717,355 | A | 1/1988 | Mattis |
| 4,738,009 | A | 4/1988 | Down et al. |
| 4,746,305 | A | 5/1988 | Nomura |
| 4,747,786 | A | 5/1988 | Hayashi et al. |
| 4,755,152 | A | 7/1988 | Elliot et al. |
| 4,761,146 | A | 8/1988 | Sohoel |
| 4,772,222 | A | 9/1988 | Laudig et al. |
| 4,789,355 | A | 12/1988 | Lee |
| 4,806,116 | A | 2/1989 | Ackerman |
| 4,813,886 | A | 3/1989 | Roos et al. |
| 4,834,675 | A | 5/1989 | Samchisen |
| 4,854,893 | A | 8/1989 | Morris |
| 4,857,014 | A | 8/1989 | Alf et al. |
| 4,869,679 | A | 9/1989 | Szegda |
| 4,874,331 | A | 10/1989 | Iverson |
| 4,892,275 | A | 1/1990 | Szegda |
| 4,902,246 | A | 2/1990 | Samchisen |
| 4,906,207 | A | 3/1990 | Banning et al. |
| 4,923,412 | A | 5/1990 | Morris |
| 4,925,403 | A | 5/1990 | Zorzy |
| 4,927,385 | A | 5/1990 | Cheng |
| 4,929,188 | A | 5/1990 | Lionetto et al. |
| 4,952,174 | A | 8/1990 | Sucht et al. |
| 4,957,456 | A | 9/1990 | Olson et al. |
| 4,973,265 | A | 11/1990 | Heeren |
| 4,979,911 | A | 12/1990 | Spencer |
| 4,990,104 | A | 2/1991 | Schieferly |
| 4,990,105 | A | 2/1991 | Karlovich |
| 4,990,106 | A | 2/1991 | Szegda |
| 5,002,503 | A | 3/1991 | Campbell et al. |
| 5,007,861 | A | 4/1991 | Stirling |
| 5,021,010 | A | 6/1991 | Wright |
| 5,024,606 | A | 6/1991 | Ming-Hwa |
| 5,037,328 | A | 8/1991 | Karlovich |
| 5,062,804 | A | 11/1991 | Jamet et al. |
| 5,066,248 | A | 11/1991 | Gaver, Jr. et al. |
| 5,073,129 | A | 12/1991 | Szegda |
| 5,083,943 | A | 1/1992 | Tarrant |
| 5,120,260 | A | 6/1992 | Jackson |
| 5,127,853 | A | 7/1992 | McMills et al. |
| 5,131,862 | A | 7/1992 | Gershfeld |
| 5,141,451 | A | 8/1992 | Down |
| 5,161,993 | A | 11/1992 | Leibfried, Jr. |
| 5,195,906 | A | 3/1993 | Szegda |
| 5,205,761 | A | 4/1993 | Nilsson |
| 5,207,602 | A | 5/1993 | McMills et al. |
| 5,217,391 | A | 6/1993 | Fisher, Jr. |
| 5,217,393 | A | 6/1993 | Del Negro et al. |
| 5,269,701 | A | 12/1993 | Leibfried, Jr. |
| 5,283,853 | A | 2/1994 | Szegda |
| 5,284,449 | A | 2/1994 | Vaccaro |
| 5,295,864 | A | 3/1994 | Birch et al. |
| 5,316,494 | A | 5/1994 | Flanagan et al. |
| 5,338,225 | A | 8/1994 | Jacobsen et al. |
| 5,342,218 | A | 8/1994 | McMills et al. |
| 5,354,217 | A | 10/1994 | Gabel et al. |
| 5,371,819 | A | 12/1994 | Szegda |
| 5,371,821 | A | 12/1994 | Szegda |
| 5,371,827 | A | 12/1994 | Szegda |
| 5,393,244 | A | 2/1995 | Szegda |
| 5,431,583 | A | 7/1995 | Szegda |
| 5,435,745 | A | 7/1995 | Booth |
| 5,444,810 | A * | 8/1995 | Szegda ..... 385/139 |
| 5,455,548 | A | 10/1995 | Grandchamp et al. |
| 5,456,611 | A | 10/1995 | Henry et al. |
| 5,456,614 | A | 10/1995 | Szegda |
| 5,466,173 | A | 11/1995 | Down |
| 5,470,257 | A | 11/1995 | Szegda |
| 5,494,454 | A | 2/1996 | Johnsen |
| 5,501,616 | A | 3/1996 | Holliday |

| | | | | |
|---|---|---|---|---|
| 5,525,076 | A | 6/1996 | Down | |
| 5,542,861 | A | 8/1996 | Anhalt et al. | |
| 5,548,088 | A | 8/1996 | Gray et al. | |
| 5,571,028 | A | 11/1996 | Szegda | |
| 5,586,910 | A | 12/1996 | Del Negro et al. | |
| 5,598,132 | A | 1/1997 | Stabile | |
| 5,607,325 | A | 3/1997 | Toma | |
| 5,620,339 | A | 4/1997 | Gray et al. | |
| 5,632,651 | A | 5/1997 | Szegda | |
| 5,651,699 | A | 7/1997 | Holliday | |
| 5,667,405 | A | 9/1997 | Holliday | |
| 5,863,220 | A | 1/1999 | Holliday | |
| 5,879,191 | A | 3/1999 | Burris | |
| 5,967,852 | A | 10/1999 | Follingstad et al. | |
| 5,975,951 | A | 11/1999 | Burris et al. | |
| 5,997,350 | A | 12/1999 | Burris et al. | |
| 6,032,358 | A | 3/2000 | Wild | |
| 6,089,912 | A | 7/2000 | Tallis | |
| 6,089,913 | A | 7/2000 | Holliday | |
| 6,146,197 | A | 11/2000 | Holliday et al. | |
| 6,210,222 | B1 | 4/2001 | Langham et al. | |
| 6,217,383 | B1 | 4/2001 | Holland | |
| 6,241,553 | B1 | 6/2001 | Hsia | |
| 6,261,126 | B1 | 7/2001 | Stirling | |
| 6,331,123 | B1 * | 12/2001 | Rodrigues | 439/584 |
| D458,904 | S | 6/2002 | Montena | |
| D460,739 | S | 7/2002 | Fox | |
| D460,740 | S | 7/2002 | Montena | |
| D460,946 | S | 7/2002 | Montena | |
| D460,947 | S | 7/2002 | Montena | |
| D460,948 | S | 7/2002 | Montena | |
| 6,425,782 | B1 | 7/2002 | Holland | |
| D461,166 | S | 8/2002 | Montena | |
| D461,167 | S | 8/2002 | Montena | |
| D461,778 | S | 8/2002 | Fox | |
| D462,058 | S | 8/2002 | Montena | |
| D462,060 | S | 8/2002 | Fox | |
| D462,327 | S | 9/2002 | Montena | |
| D468,696 | S | 1/2003 | Montena | |
| 6,530,807 | B2 | 3/2003 | Rodrigues et al. | |
| 6,558,194 | B2 | 5/2003 | Montena | |
| 6,767,248 | B1 * | 7/2004 | Hung | 439/578 |
| 6,783,394 | B1 * | 8/2004 | Holliday | 439/578 |
| 6,805,584 | B1 | 10/2004 | Chen | |
| 6,817,896 | B2 * | 11/2004 | Derenthal | 439/578 |
| 6,848,940 | B2 | 2/2005 | Montena | |
| 6,884,113 | B1 * | 4/2005 | Montena | 439/578 |
| 7,118,416 | B2 * | 10/2006 | Montena et al. | 439/584 |
| 7,455,549 | B2 * | 11/2008 | Rodrigues et al. | 439/578 |
| 7,458,849 | B2 * | 12/2008 | Rodrigues et al. | 439/578 |
| 7,458,851 | B2 * | 12/2008 | Montena | 439/584 |
| 2004/0102089 | A1 | 5/2004 | Chee | |
| 2004/0229504 | A1 | 11/2004 | Liu | |
| 2005/0208827 | A1 | 9/2005 | Burris et al. | |
| 2008/0274644 | A1 * | 11/2008 | Rodrigues | 439/583 |
| 2010/0081321 | A1 * | 4/2010 | Malloy et al. | 439/578 |
| 2010/0081322 | A1 * | 4/2010 | Malloy et al. | 439/578 |

FOREIGN PATENT DOCUMENTS

| | | | |
|---|---|---|---|
| DE | 102289 | | 7/1897 |
| DE | 1117687 | | 11/1961 |
| DE | 1 515 398 | | 11/1962 |
| DE | 1 191 880 | | 4/1965 |
| DE | 2 221 936 | | 4/1972 |
| DE | 2 225 764 | | 5/1972 |
| DE | 2 261 973 | | 12/1972 |
| DE | 32 11 008 | A1 | 10/1983 |
| EP | 0 072 104 | B1 | 2/1983 |
| EP | 0 116 157 | A1 | 8/1984 |
| EP | 0 167 738 | A2 | 1/1986 |
| EP | 0 265 276 | B1 | 4/1988 |
| FR | 2 232 846 | | 6/1973 |
| FR | 2 234 680 | | 6/1974 |
| FR | 2 462 798 | | 2/1981 |
| GB | 589697 | | 3/1945 |
| GB | 1087228 | | 10/1967 |
| GB | 1 270 846 | | 4/1972 |
| GB | 2019 665 | A | 10/1979 |
| GB | 2 079 549 | A | 1/1982 |
| GB | 2079 549 | A | 1/1982 |
| WO | WO 93/24973 | | 12/1993 |
| WO | WO 96/08854 | | 3/1996 |
| WO | WO 01/86756 | | 11/2001 |

OTHER PUBLICATIONS

Sell Sheet from PCT International; Reader Service No. 133; regarding DRS Compression Connectors—description/features and benefits.

* cited by examiner

A
10
12
14
16
20
22
24
26
30
32
40
42
44
46
52
54
56
58
60
62
64
66
100
102
104
106
110

COAXIAL CABLE CONNECTOR WITH INNER SLEEVE RING

CROSS-REFERENCE TO RELATED APPLICATIONS

This application claims the benefit of U.S. Provisional Application No. 60/926,986, filed on May 1, 2007, which is incorporated by reference herein in its entirety for all purposes.

BACKGROUND OF THE INVENTION

The present invention relates generally to connectors for terminating coaxial cable. More particularly, the present invention relates to a coaxial cable connector having structural features to increase the range of cable sizes that can be accepted by the connector.

It has long been known to use connectors to terminate coaxial cable so as to connect a cable to various electronic devices such as televisions, radios and the like. Prior art coaxial connectors generally include a connector body having an annular collar for accommodating a coaxial cable, an annular nut rotatably coupled to the collar for providing mechanical attachment of the connector to an external device and an annular post interposed between the collar and the nut. A resilient sealing O-ring may also be positioned between the collar and the nut at the rotatable juncture thereof to provide a water resistant seal thereat. The collar includes a cable receiving end for insertably receiving an inserted coaxial cable and, at the opposite end of the connector body, the nut includes an internally threaded end extent permitting screw threaded attachment of the body to an external device.

This type of coaxial connector further typically includes a locking sleeve to secure the cable within the body of the coaxial connector. The locking sleeve, which is typically formed of a resilient plastic, is securable to the connector body to secure the coaxial connector thereto. In this regard, the connector body typically includes some form of structure to cooperatively engage the locking sleeve. Such structure may include one or more recesses or detents formed on an inner annular surface of the connector body, which engages cooperating structure formed on an outer surface of the sleeve. A coaxial cable connector of this type is shown and described in commonly owned U.S. Pat. No. 6,530,807.

Conventional coaxial cables typically include a center conductor surrounded by an insulator. A conductive foil is disposed over the insulator and a braided conductive shield surrounds the foil covered insulator. An outer insulative jacket surrounds the shield. In order to prepare the coaxial cable for termination, the outer jacket is stripped back exposing an extent of the braided conductive shield which is folded back over the jacket. A portion of the insulator covered by the conductive foil extends outwardly from the jacket and an extent of the center conductor extends outwardly from within the insulator.

Upon assembly, a coaxial cable is inserted into the cable receiving end of the connector body, wherein the annular post is forced between the foil covered insulator and the conductive shield of the cable. In this regard, the post is typically provided with a radially enlarged barb to facilitate expansion of the cable jacket. The locking sleeve is then moved axially into the connector body to clamp the cable jacket against the post barb providing both cable retention and a water-tight seal around the cable jacket.

Generally, such prior art connectors are designed to work for coaxial cables of a specified diameter. In other words, typical prior art coaxial cable connectors are not suitably designed to accommodate a range of cable diameters. For example, a connector adapted to connect with a relatively small diameter cable is typically designed with reduced internal dimensions making connection with a larger diameter cable impossible. Conversely, connectors adapted for larger diameter cables have larger internal dimensions, which do not adequately retain and seal smaller diameter cables.

A further problem with current coaxial connectors is that in order to properly attach the connector to the coaxial cable, a good deal of manual force must be applied to push the coaxial shielded cable over the barbs of the post. During conventional installation, the cable can buckle when the post with the barb is pushed between the foil and the braid and create an unsatisfactory electrical and mechanical connection. Thus, a mistake made in the preparation process may result in a faulty connector installation.

It is, therefore, desirable to provide a coaxial connector with structural features to enhance gripping and sealing of coaxial cables having a wide range of diameters. It would be further desirable to provide a coaxial cable connector that eliminates the need to use excessive force to push the post into the coaxial shielded cable and prevents buckling of the coaxial shielded cable.

OBJECTS AND SUMMARY OF THE INVENTION

It is an object of the present invention to provide a coaxial cable connector for terminating a coaxial cable.

It is a further object of the present invention to provide a coaxial cable connector having structure to enhance gripping and sealing of varying sizes of coaxial cables.

In the efficient attainment of these and other objects, the present invention provides a coaxial cable connector. The connector of the present invention generally includes a connector body having a rearward cable receiving end, a locking sleeve movably coupled to the rearward cable receiving end of the connector body and a sleeve ring movably disposed within a rearward sleeve ring receiving end of the locking sleeve. The sleeve ring has a forward end for retaining a cable within the connector upon forward insertion of the sleeve ring within the locking sleeve. The connector further preferably includes an annular post disposed within the connector body, wherein the forward end of the sleeve ring urges the cable against the post upon forward insertion of the sleeve ring within the locking sleeve.

In a preferred embodiment, the locking sleeve includes a sleeve flange formed on an inner surface thereof and the sleeve flange includes a flexible skirt. The forward end of the sleeve ring engages the flexible skirt upon forward insertion of the sleeve ring within the locking ring to deflect the flexible skirt radially inward whereby the skirt engages the cable to retain the cable within the connector.

In an alternative embodiment, the connector further includes a cable gripping O-ring disposed within the locking sleeve. The forward end of the sleeve ring compresses the O-ring upon forward insertion of the sleeve ring within the locking sleeve to expand the O-ring radially inward. In this manner, the O-ring engages the cable to retain the cable within the connector and to provide a seal around the cable.

In another alternative embodiment, the locking sleeve includes a sleeve flange formed on an inner surface thereof and the sleeve flange includes a ramped portion. In this embodiment, the forward end of the sleeve ring includes a deformable edge portion, which engages the flange ramped portion upon forward insertion of the sleeve ring within the locking sleeve, whereby the deformable edge portion is deflected radially inward to engage the cable and retain the cable within the connector.

The present invention further involves a coaxial cable connector including a connector body, a locking sleeve movably coupled to a rearward cable receiving end of the connector body and a cable gripping ferrule disposed in the connector body forward of the locking sleeve. The connector body further includes a first engagement portion having a first internal diameter and a second engagement portion having a second internal diameter, wherein the second internal diameter is smaller than the first internal diameter. When the locking sleeve is moved forward, it forces the cable gripping ferrule from the first engagement portion of the connector body into the second engagement portion, wherein the gripping ferrule compresses in a radially inward direction for engaging a cable inserted in the connector.

The cable gripping ferrule can be in the form of a split ring formed separate from the locking sleeve, wherein the ring has an outer diameter substantially equal to the first internal diameter of the connector body first engagement portion. Alternatively, the cable gripping ferrule can be an integral forward portion of the locking sleeve, wherein the portion has at least one slot formed therein to facilitate its radially inward compression.

In either case, the gripping ferrule preferably has a length, a first substantially constant outer diameter along its entire length when the gripping ferrule is disposed in the connector body first engagement portion and a second substantially constant outer diameter along its entire length when the gripping ferrule is disposed in the connector body second engagement portion. The second substantially constant outer diameter is smaller than the first substantially constant outer diameter.

The present invention further involves a method for terminating a coaxial cable in a connector. The method generally includes the steps of inserting an end of a cable into a rearward cable receiving end of a connector body, axially moving a locking sleeve coupled to the connector body in a forward direction and axially moving a sleeve ring within the locking sleeve in a forward direction, wherein the sleeve ring has a forward end for retaining a cable within the connector upon forward insertion of the sleeve ring within the locking sleeve.

A preferred form of the coaxial connector, as well as other embodiments, objects, features and advantages of this invention, will be apparent from the following detailed description of illustrative embodiments thereof, which is to be read in conjunction with the accompanying drawings.

DETAILED DESCRIPTION OF THE PREFERRED EMBODIMENTS

Figure 1:
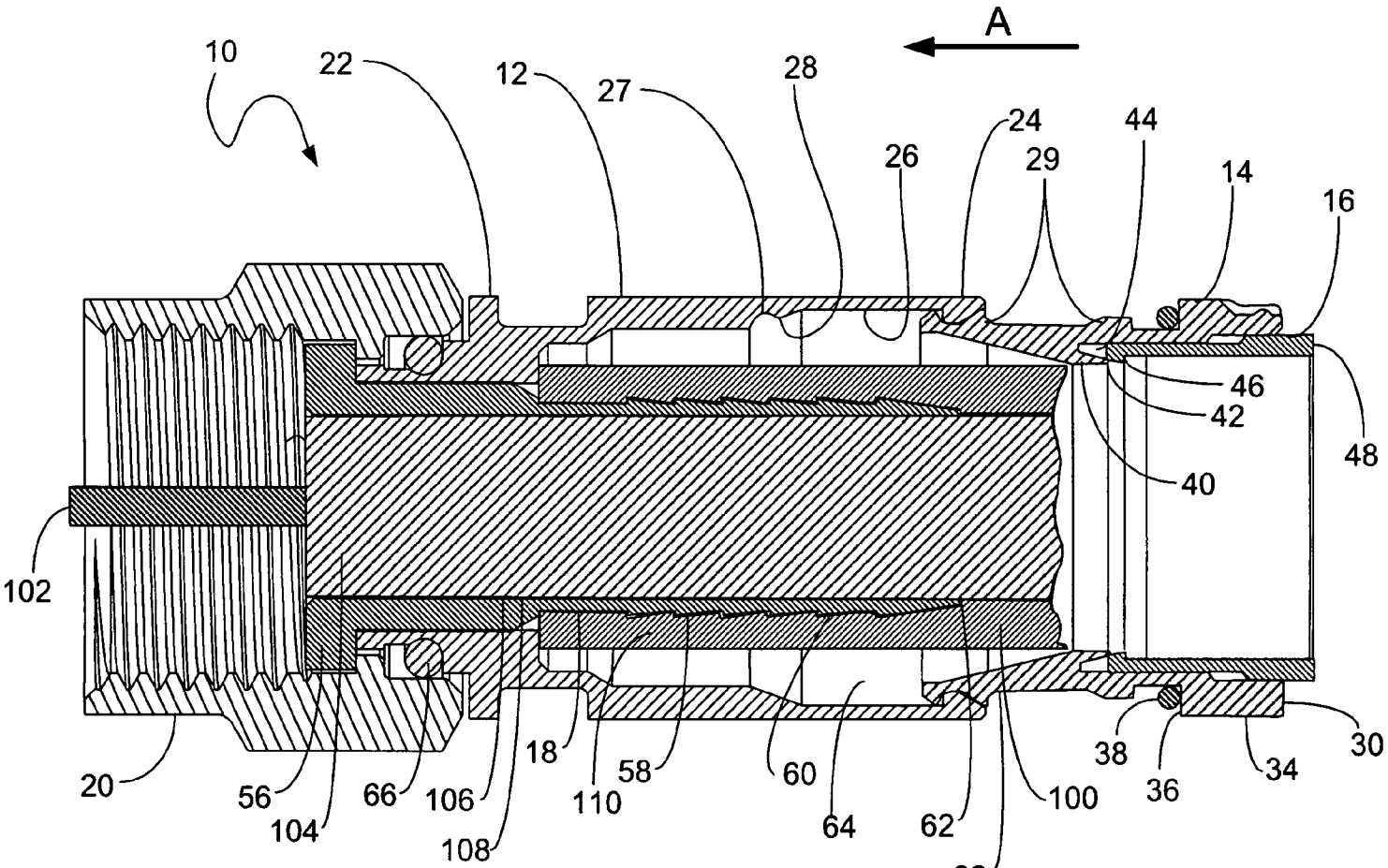
FIG. 1 is a cross-sectional view of a preferred embodiment of the coaxial cable connector of the present invention in its open position.
Figures 2, 2A:
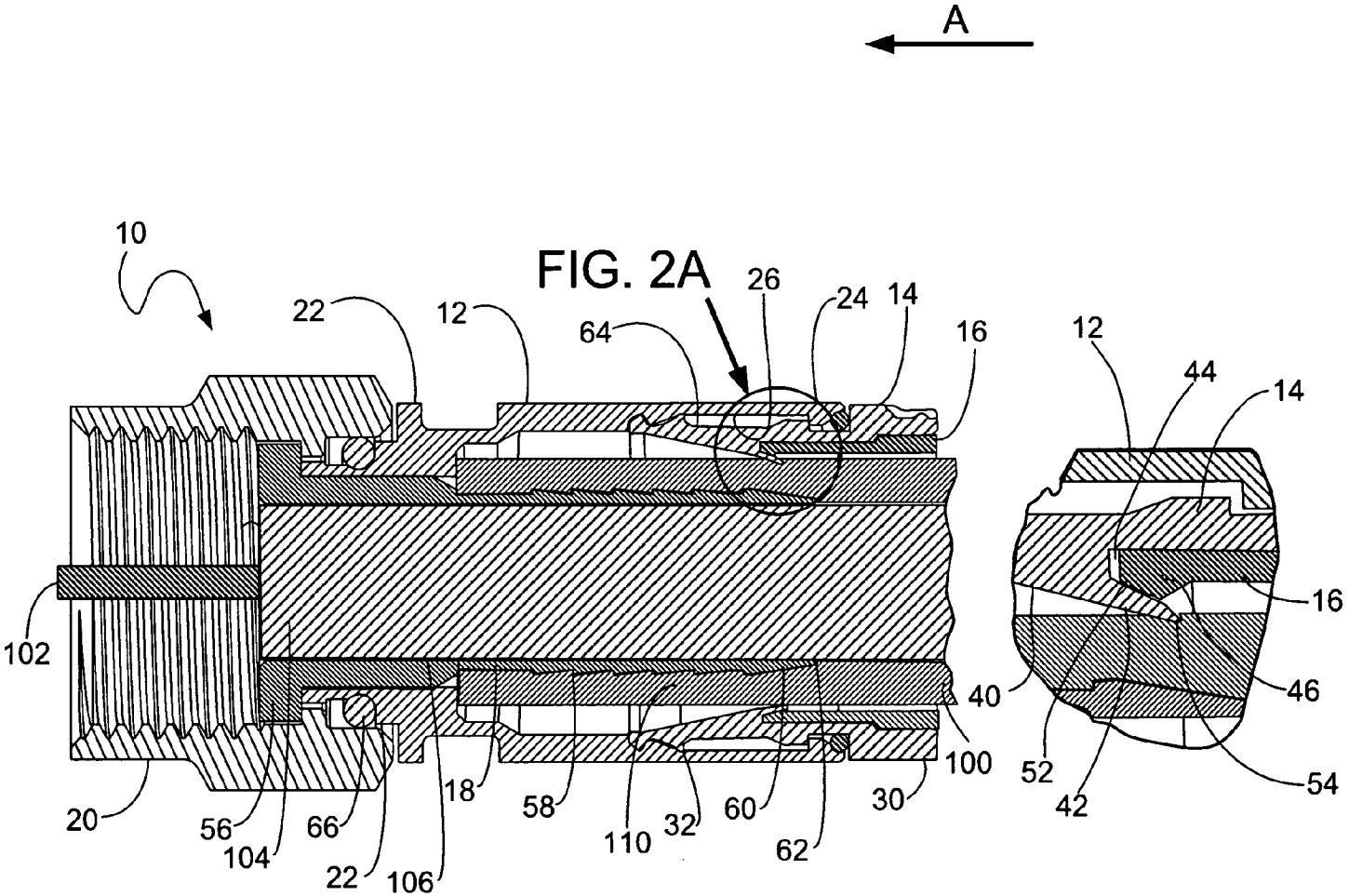
FIG. 2 is a cross-sectional view of the connector shown in FIG. 1 in its closed position.
FIG. 2*a* is an enlarged detail view of the interaction between the inner sleeve ring and the locking sleeve flange shown in FIG. 2.

Referring first to FIGS. 1 and 2, a preferred embodiment of the coaxial cable connector 10 of the present invention is shown. The connector 10 generally includes a connector body 12, a locking sleeve 14, an inner sleeve ring 16, an annular post 18 and a rotatable nut 20. It is however conceivable that the connector body 12 and the post 18 can be integrated into one component and/or another fastening device other than the rotatable nut 20 can be utilized.

The connector body 12, also called a collar, is an elongate generally cylindrical member, which can be made from plastic or from metal or the like. The body 12 has a forward end 22 coupled to the post 18 and the nut 20 and an opposite cable receiving end 24 for insertably receiving the locking sleeve 14, as well as a prepared end of a coaxial cable in the forward direction as shown by arrow A. The cable receiving end 24 of the connector body 12 defines an inner sleeve engagement surface 26 for coupling with the locking sleeve 14. The inner engagement surface 26 is preferably formed with an arrangement of grooves or recesses 27 and protrusions 28, which cooperate with mating detent structure 29 provided on the outer surface of the locking sleeve 14.

The locking sleeve 14 is a generally tubular member having a rearward cable receiving end 30 and an opposite forward connector insertion end 32, which is movably coupled to the inner surface 26 of the connector body 12. As mentioned above, the outer cylindrical surface of the sleeve 14 at its forward end 32 includes a plurality of ridges or projections 29, which cooperate with a plurality of recesses 27 and protrusions 28 formed in the inner sleeve engagement surface 26 of the connector body 12 to allow for the movable connection of the sleeve 14 to the connector body 12 such that the sleeve is lockingly axially moveable along arrow A toward the forward end 22 of the connector body from a first position, as shown in FIG. 1, which loosely retains the cable within the connector 10, to a more forward second position, as shown in FIG. 2, which secures the cable within the connector.

Preferably, there are two ridges 29 to provide locking of the sleeve 14 in both its first and second positions. Each ridge 29 is further preferably defined by a rearwardly facing perpendicular wall and a forwardly facing chamfered wall. This structure facilitates forward insertion of the sleeve 14 into the body 12 in the direction of arrow A and resists rearward removal of the sleeve from the body.

Moreover, the ridges or projections 29 of the present invention may take other forms. For example, while each ridge 29 is shown in the drawings to be continuous about the circumference of the locking sleeve 14, it is conceivable to provide gaps or spaces in one or more ridges to increase the ridge's flexibility. Also, the ridges 29 can be provided on the inner sleeve engagement surface 26 of the connector body 12, while the grooves are formed on the outer cylindrical surface of the sleeve 14.

The locking sleeve 14 further preferably includes a flanged head portion 34 disposed at the rearward cable receiving end 30 thereof. The head portion 34 has an outer diameter larger than the inner diameter of the body 12 and includes a forward facing perpendicular wall 36, which serves as an abutment surface against which the rearward end of the body 12 stops to prevent further insertion of the sleeve 14 into the body 12. A resilient, sealing O-ring 38 is preferably provided at the forward facing perpendicular wall 36 to provide a water-tight seal between the locking sleeve 14 and the connector body 12 upon insertion of the locking sleeve within the body.

The locking sleeve 14 further includes an annular sleeve flange 40 formed on the inner cylindrical surface of the locking sleeve. The sleeve flange 40 extends radially inward from the inner surface of the locking sleeve 14 and includes a rearward extending flexible skirt 42, which engages the inner sleeve ring 16 in a manner which will be described below. The flexible skirt 42 is preferably formed continuous around the inner surface of the locking sleeve 14. Alternatively, the flexible skirt 42 can consist of a series of annularly disposed individual flexible fingers, where sealing is not required. In either event, the rearward extending flexible skirt 42 and the inner surface of the locking sleeve 14 define an annular gap 44, which receives a forward end 46 of the inner sleeve ring 16.

The inner sleeve ring 16 is also a generally tubular member having a forward end 46 and an opposite rearward cable receiving end 48. The inner sleeve ring is axially movable within the rearward cable receiving end 30 of the locking sleeve 14 between a first, open position, as shown in FIG. 1, to a second closed position, as shown in FIG. 2. In this regard, the outer surface of the ring 16 and the inner surface of the locking sleeve 14 are preferably press-fit together. However, alternative structures, such as a cooperating detent structure (not shown), can be provided for locking the inner sleeve ring to the locking sleeve in one of its two positions.

As mentioned above, the forward end 46 of the inner sleeve ring 16 is received within the annular gap 44 defined between the flexible skirt 42 and the inner surface of the locking sleeve 14. As will be discussed in further detail below, forward movement of the inner sleeve ring 16, in the direction of arrow A, will cause the flexible skirt 42 of the locking sleeve flange 42 to deflect radially inward, as shown in the enlarged view of FIG. 2A. Such inward deflection causes the flexible skirt 42 to grip the outer jacket of a cable inserted within the connector 10.

To facilitate the radially inward deflection of the flexible skirt 42, the forward end 46 of the inner sleeve ring 16 is preferably formed with a forward facing ramp portion 52 on its inner surface, which urges the flexible skirt 42 radially inward as the inner sleeve ring moves in the forward direction along arrow A. Also, the flexible skirt 42 preferably terminates at a rearward facing sharp edge 54 to facilitate "biting" into the cable jacket as the skirt deflects inward.

As mentioned above, the connector 10 of the present invention further preferably includes an annular post 18 coupled to the forward end 22 of the connector body 12. The annular post 18 includes a flanged base portion 56 at its forward end for securing the post to the connector body 12 and an annular tubular extension 58 extending rearwardly within the body 12 and terminating adjacent the forward end 32 of the connector body 12. The rearward end of the tubular extension 58 preferably includes a radially outwardly extending ramped flange portion or "barb" 60 to enhance compression of the outer jacket of the coaxial cable against the flexible skirt 42 of the inner sleeve ring 16 to secure the cable within the connector 10. The tubular extension 58 can include a series of such barbs 60 for gripping the cable. In any event, the rearward end of the tubular extension 58 preferably terminates in a sharp edge 62, which facilitates separation of the metallic foil from the metallic shield of the cable during installation, as will be discussed in further detail below. The tubular extension 58 of the post 18, the locking sleeve 14 and the body 12 define an annular chamber 64 for accommodating the jacket and shield of the inserted coaxial cable.

The connector 10 of the present invention further preferably includes a nut 20 rotatably coupled to the forward end 22 of the connector body 12. The nut 20 may be in any form, such as a hex nut, knurled nut, wing nut, or any other known attaching means, and is rotatably coupled to the connector body 12 for providing mechanical attachment of the connector 10 to an external device. A resilient sealing O-ring 66 is preferably positioned in the nut 20 to provide a water resistant seal thereat.

The connector 10 of the present invention is constructed so as to be supplied in the assembled condition shown in the drawings, wherein the locking sleeve 14 and the inner sleeve ring 16 are pre-installed inside the rearward cable receiving end 24 of the connector body 12. In such assembled condition, and as will be described in further detail hereinbelow, a coaxial cable may be inserted through the rearward cable receiving end 48 of the inner sleeve ring 16 to engage the post 18 of the connector 10. However, it is conceivable that the locking sleeve 14 and the inner sleeve ring 16 can be first slipped over the end of a cable and then be inserted into the rearward end 24 of the connector body 12 together with the cable.

Having described the components of the connector 10 in detail, the use of the connector in terminating a coaxial cable 100 may now be described. Coaxial cable 100 includes an inner conductor 102 formed of copper or similar conductive material. Extending around the inner conductor 102 is an insulator 104 formed of a dielectric material, such as a suitably insulative plastic. A metallic foil 106 is disposed over the insulator 104 and a metallic shield 108 is positioned in surrounding relationship around the foil covered insulator. Covering the metallic shield 108 is an outer insulative jacket 110.

The end of the cable 100 is inserted into the connector body 12 so that the cable jacket 110 is separated from the insulator 104 by the sharp edge 62 of the annular post 18. Once the cable 100 is fully inserted in the connector body 12, the locking sleeve 14 is moved axially forward in the direction of arrow A from the first position shown in FIG. 1 to the second position shown in FIG. 2. This may be accomplished with a suitable compression tool. As the sleeve 14 is moved axially forward, the inner sleeve flange 40 provides compressive force on the cable jacket 110 against the barb 60 of the annular post 18.

Next, or at the same time, the inner sleeve ring 16 is driven forward in the direction of arrow A to further lock the cable 100 in the connector 10. Movement of the inner sleeve ring 16 can be accomplished with the same compression tool used to drive the locking sleeve 14, or a different compression tool. As described above, inward axial movement of the inner sleeve ring 16 causes the flexible skirt 42 of the inner sleeve flange 40 to expand radially inward to grip the outer surface of the cable jacket 110. Thus, as a result of the present invention, the cable 100 is prevented from being easily pulled out of the connector 10.

FIGS. 3-8 show an alternative embodiment of a connector 70, 70*a* of the present invention, wherein the internal flexible skirt 42 of the locking sleeve 14 has been replaced by a cable gripping ferrule 72, 72*a* and a cable sealing O-ring 74. The connector 70, 70*a* shown in FIGS. 3-8 is similar in most respects to the connector 10 described above with respect to FIGS. 1-2A. Specifically, the connector 70, 70*a* generally includes a connector body 12, a locking sleeve 14, 14*a*, an inner sleeve ring 16, an annular post 18 and a rotatable nut 20, as described above.

Figure 3:
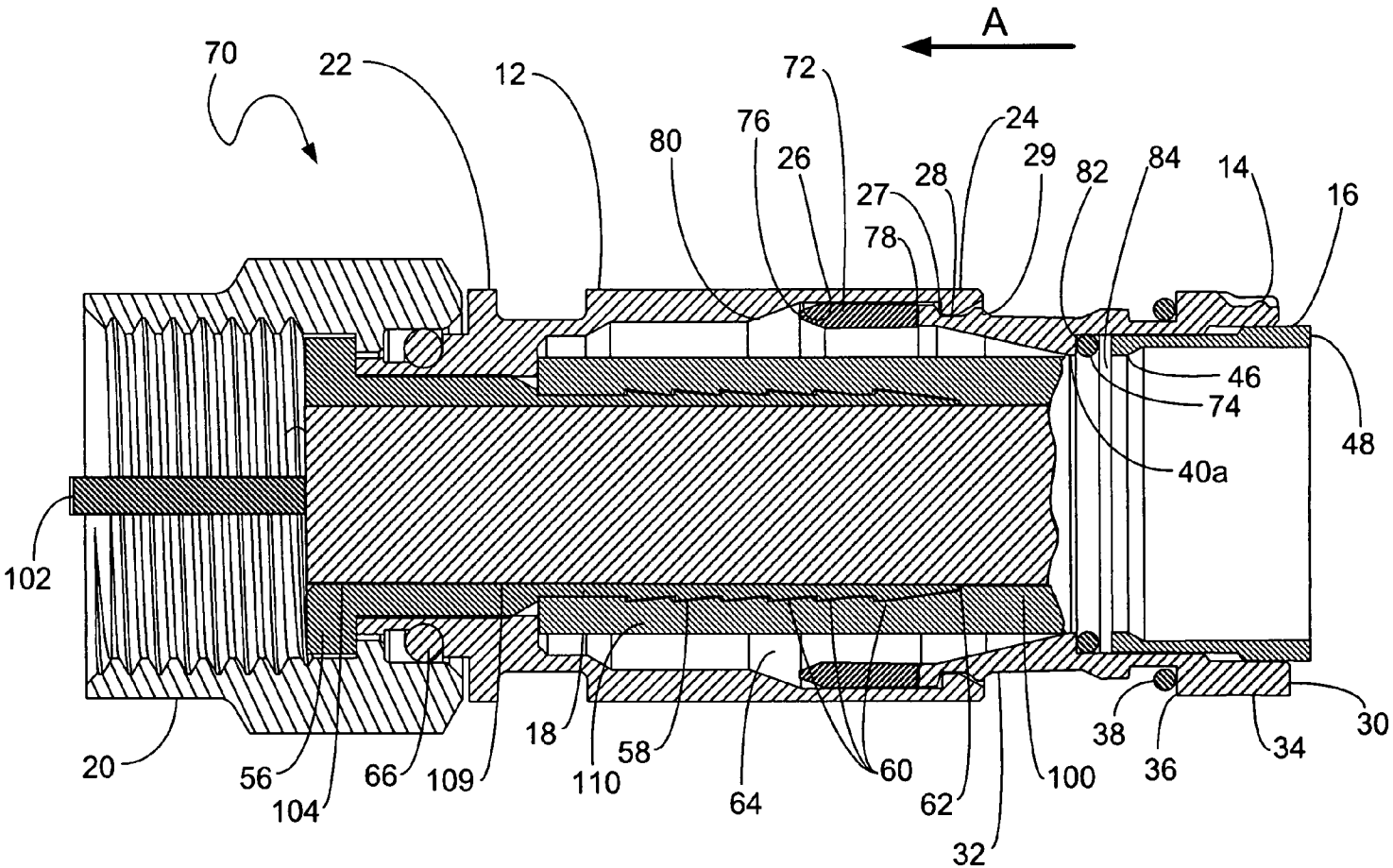
FIG. 3 is a cross-sectional view of an alternative embodiment of the coaxial cable connector of the present invention in its open position.
Figure 5:
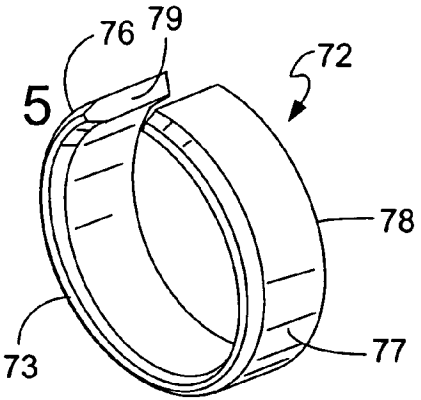
FIG. 5 is a perspective view of the cable gripping ferrule shown in FIGS. 3 and 4.
Figure 6:
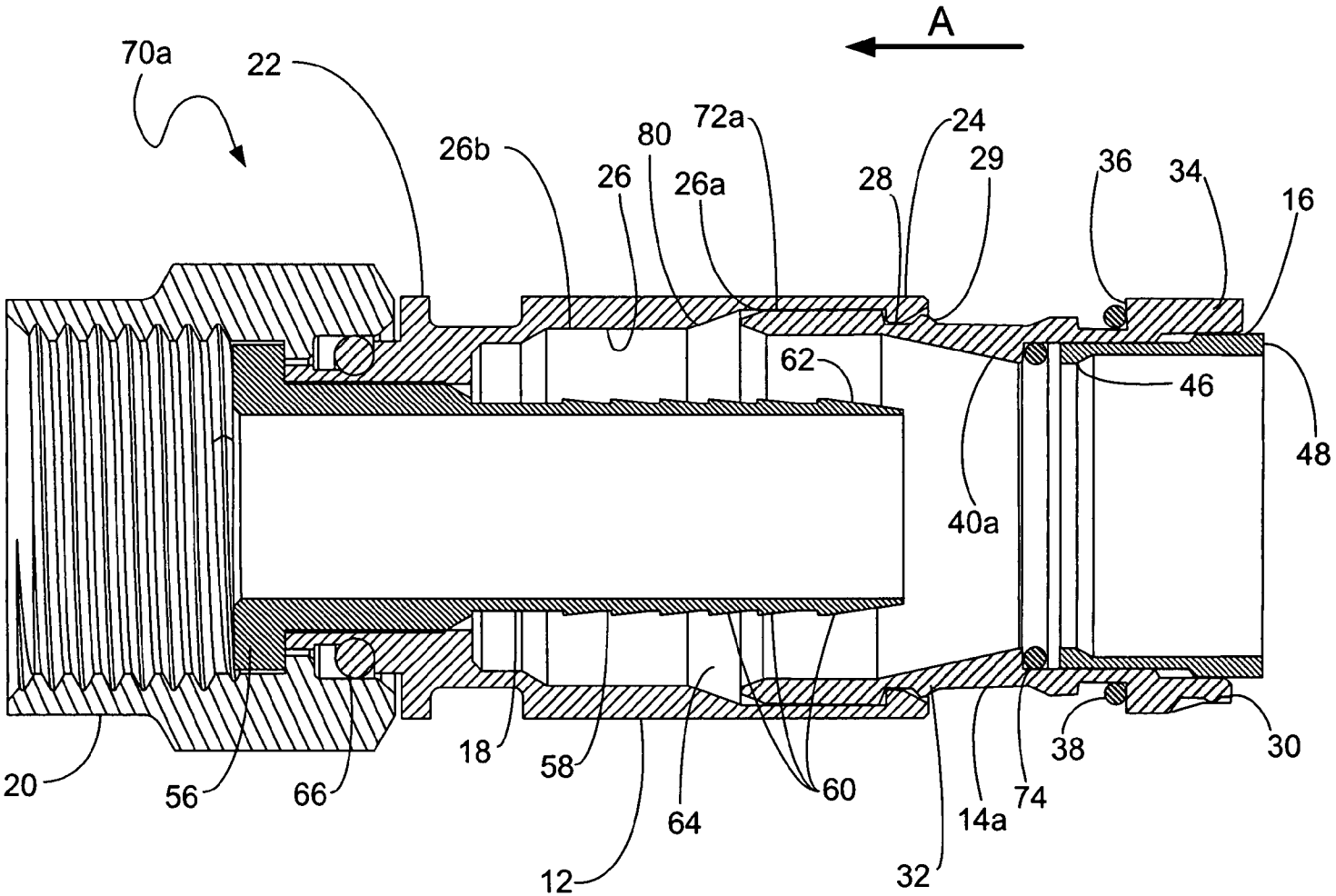
FIG. 6 is a cross-sectional view of another alternative embodiment of the coaxial cable connector of the present invention in its open position.
Figure 7:
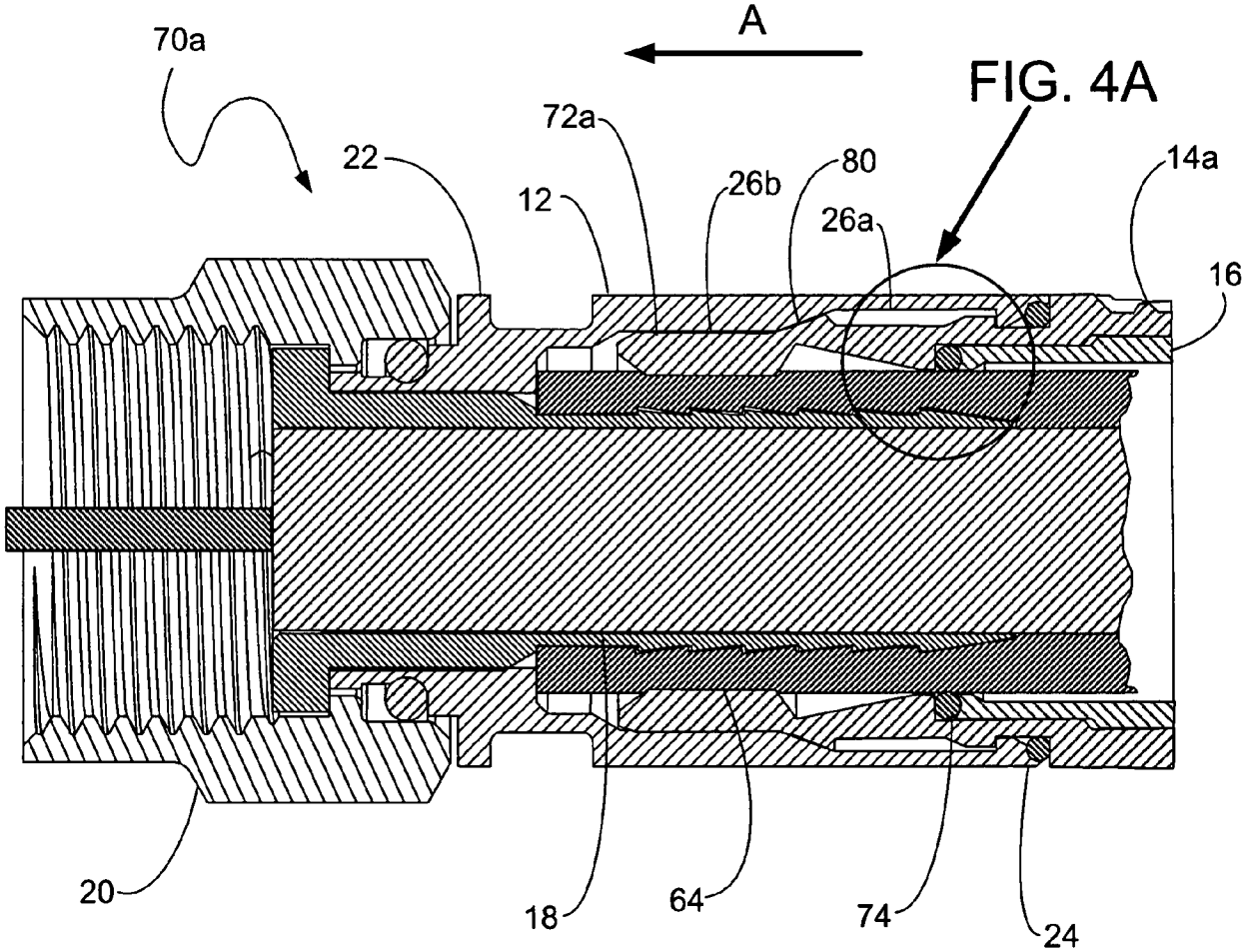
FIG. 7 is a cross-sectional view of the connector shown in FIG. 6 in its closed position.
Figure 8:
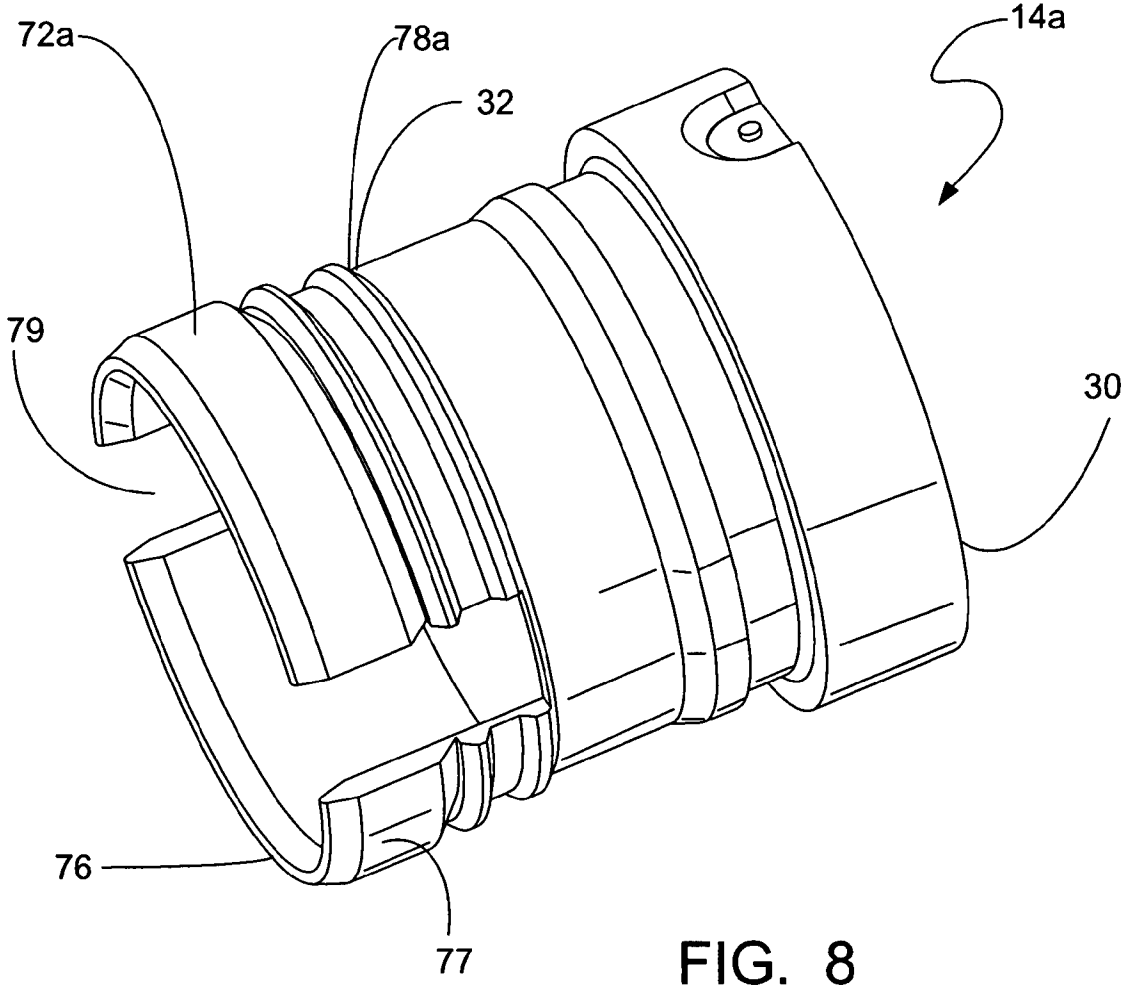
FIG. 8 is a perspective view of a preferred embodiment of a cable gripping ferrule integral with the locking sleeve.

However, in this embodiment, a cable gripping ferrule 72, 72*a* is disposed in the annular chamber 64 of the connector 70, 70*a* forward of the locking sleeve 14, 14*a*. The gripping ferrule 72 can be provided as a separate element, as shown in FIGS. 3-5, but is preferably formed as an integral forward portion 72*a* of the locking sleeve 14*a*, as shown in FIGS. 6-8. In either case, the gripping ferrule 72, 72*a* is a generally tubular member having a forward end 76 and an opposite rearward end 78. The gripping ferrule 72, 72*a* further includes an outer surface 77, which frictionally engages the inner engagement surface 26 of the connector body 12 to retain the ferrule within the rearward end 24 of the connector body 12. Thus, as assembled, the gripping ferrule 72, 72*a* is sandwiched between the forward connector insertion end 32 of the locking sleeve 14, 14*a* and the rearward cable receiving end 24 of the connector body 12.

Also in this embodiment, the inner engagement surface 26 of the connector body 12 is formed with an internal ramp portion 80, which defines a transition region on the inner surface 26 between a first inner diameter 26*a* and a smaller second inner diameter 26*b* of the connector body. As will be discussed further below, the internal ramp portion 80 of the connector body 12 facilitates forward movement of the gripping ferrule 72, 72*a* from engagement with the first internal diameter 26*a* of the engagement surface 26 to engagement with the smaller second diameter 26*b*. As the gripping ferrule 72, 72*a* moves from the first diameter 26*a* to the second smaller diameter, the ferrule collapses so that the inner dimensions of the ferrule are reduced or radially compressed to grip the outer jacket 110 of the cable 100.

Specifically, the gripping ferrule 72, 72*a* is designed to compress radially inward when pressed by the locking sleeve 14 in the forward axial direction, along arrow A, into the smaller diameter engagement surface 26*b* of the connector body 12. In particular, when provided as a separate component as shown in FIG. 5, the gripping ferrule 72 is designed as a split ring having a gap 79 that reduces in size when the ferrule is forced into the smaller diameter engagement surface 26*b* to allow inward compression of the ferrule.

When formed integral with the locking sleeve 14*a*, the gripping ferrule 72*a* is provided with one or more slots 79 that extend from the forward end 76 to the rearward end 78*a*, as shown in FIG. 8. These slots 79 allow the peripheral walls of the gripping ferrule 72*a* to collapse inwardly, when forced by the reduced diameter engagement surface 26*b* of the connector body 12, to facilitate the radial inward compression of the ferrule.

In either case, such reduction of the inner diameter of the gripping ferrule 72, 72*a* will cause the ferrule to engage the outer surface of the cable 100 to secure the cable to the connector 70, 70*a*. Secondly, the ferrule 72 provides a redundant sealing point to prevent the ingress of water or other contaminants into the connector assembly 70, 70*a*.

The forward end 76 of the gripping ferrule 72 preferably terminates at a tapered edge 73 to enhance forward movement of the ferrule within the connector body 12. It is also conceivable that the forward end 76 of the gripping ferrule can be formed with a plurality of circumferentially arranged flexible fingers (not shown) extending in the forward longitudinal direction, where sealing is not required. The fingers may be formed simply by providing longitudinal slots or recesses at the forward end 76 of the ferrule 72.

As mentioned above, the connector 70, 70*a* in this embodiment further includes a cable sealing O-ring 74 to provide a second cable retention and sealing point on the cable. The cable sealing O-ring 74 is made from a resilient sealing material, such as rubber, and is disposed between the locking sleeve 14 and the forward end 46 of the inner sleeve ring 16.

The locking sleeve 14 is preferably provided with structure for retaining the O-ring in its position. In particular, instead of having a rearward extending flexible skirt 42 described above, the sleeve flange 40*a* in this embodiment is formed with a substantially perpendicular, rearward facing wall 82, which, together with the forward end of the inner sleeve ring define an annular cable gripping O-ring space 84 in which the cable gripping O-ring is received, as shown in the enlarged view of FIG. 4A.

In use, a cable 100 is prepared and inserted into the connector 70, 70*a*, as described above, wherein the cable jacket 110 is parted from the cable insulator 104 by the sharp edge 62 of the post 18. The locking sleeve 14, 14*a* is driven forward in the direction of arrow A from a first position, as shown in FIGS. 3 and 6, to a second position, as shown in FIGS. 4 and 7. Again, a suitable compression tool can be utilized and cooperating detent structure 78 can be provided between the connector body 12 and the locking sleeve 14, 14*a*, as described above, to positively lock the locking sleeve in its first and second positions. As the locking sleeve 14, 14*a* is driven forward, the cable gripping ferrule 72, 72*a* is forced from the first diameter 26*a* of the inner engagement surface 26, up the internal ramp portion 80 and into the smaller second diameter section 26*b* of the connector body 12, which causes the ferrule to contract radially inward against the outer surface of the cable jacket 110. The cable jacket 110 is thus retained between the cable gripping ferrule 72, 72*a* and the tubular extension 58 of the post 18. Here too, the post 18 is preferably provided with a series of post barbs 60 spaced forward of the rearward end 62 to enhance compression of the cable jacket 110 together with the cable gripping end 76 of the ferrule 72, 72*a*.

Figure 4A:
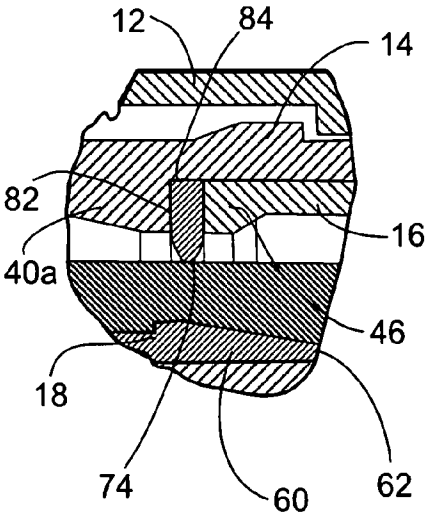
FIG. 4*a* is an enlarged detail view of the interaction between the inner sleeve ring and the O-ring shown in FIG. 4.
Figure 4:
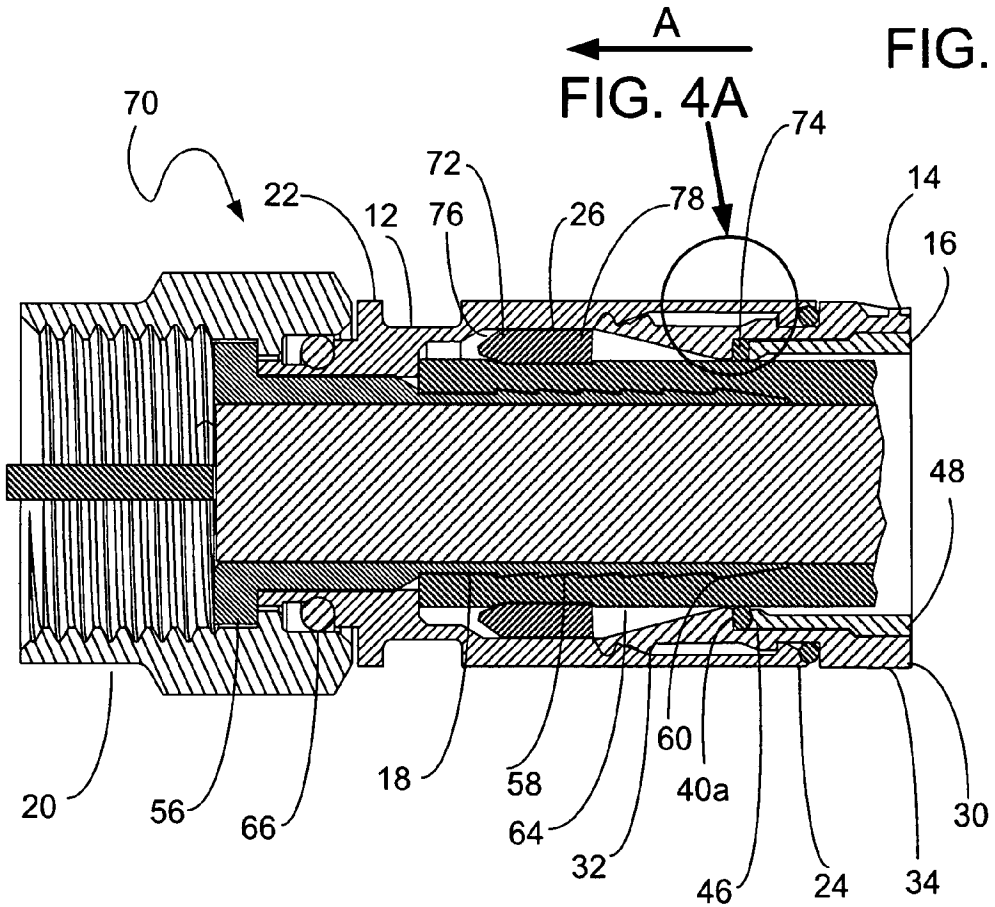
FIG. 4 is a cross-sectional view of the connector shown in FIG. 3 in its closed position.

At the same time, or subsequently, the inner sleeve ring 16 is driven forward from a first position, as shown in FIGS. 3 and 6, to a second position, as shown in FIGS. 4, 4A and 7. As the inner sleeve ring 16 is driven forward, the forward end 46 of the sleeve compresses the cable sealing O-ring 74 against the rearward facing wall 82 of the inner sleeve flange 40*a*. Such compression causes the cable gripping O-ring 74 to radially expand whereby the inner diametrical surface of the O-ring engages the outer jacket 110 of the cable 100. Thus, a second cable retention and sealing point is established, which is axially spaced from the cable retention and sealing point formed by the gripping ferrule 72.

Figure 9:
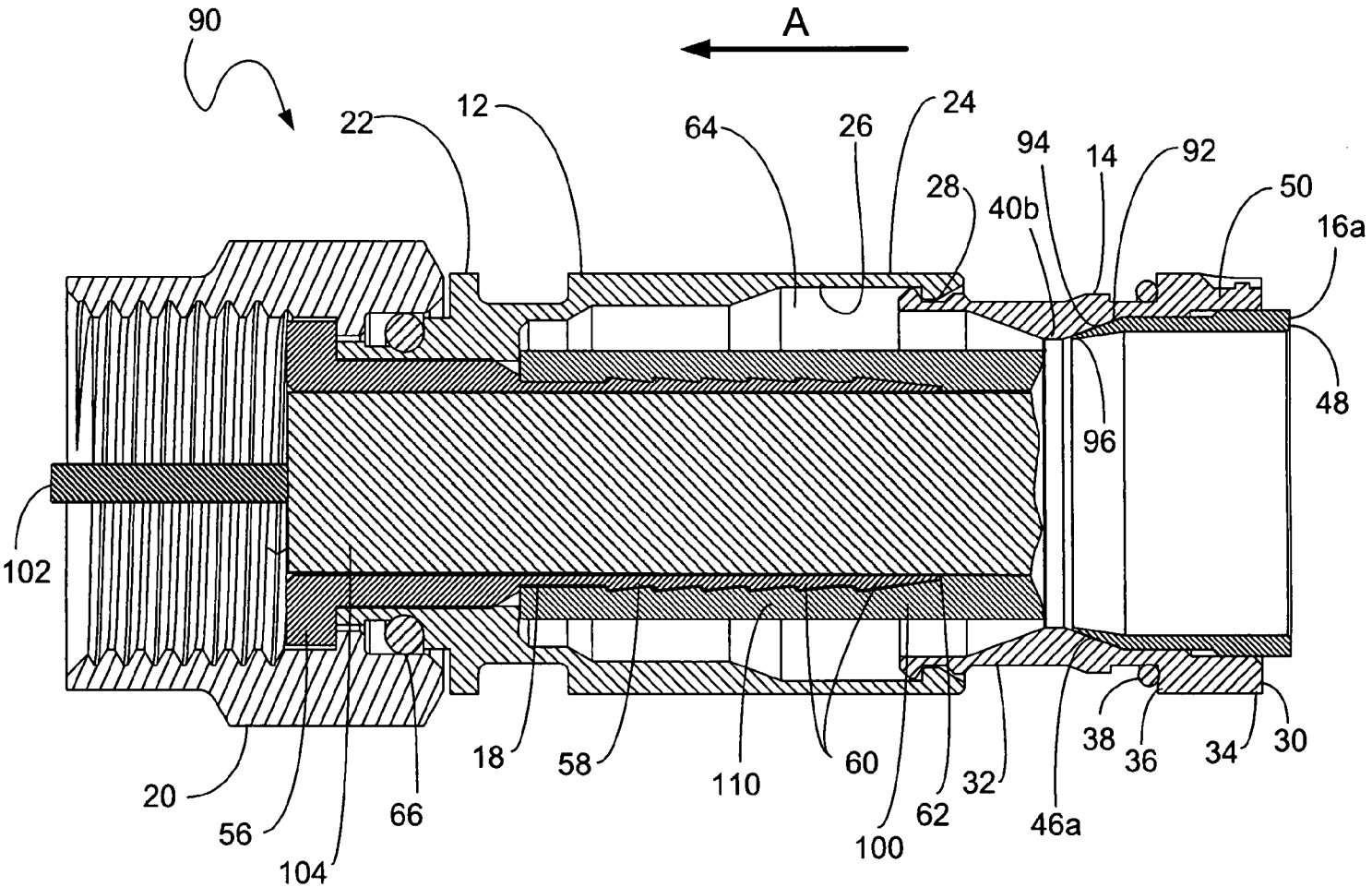
FIG. 9 is a cross-sectional view of another alternative embodiment of the coaxial cable connector of the present invention in its open position.
Figure 10:
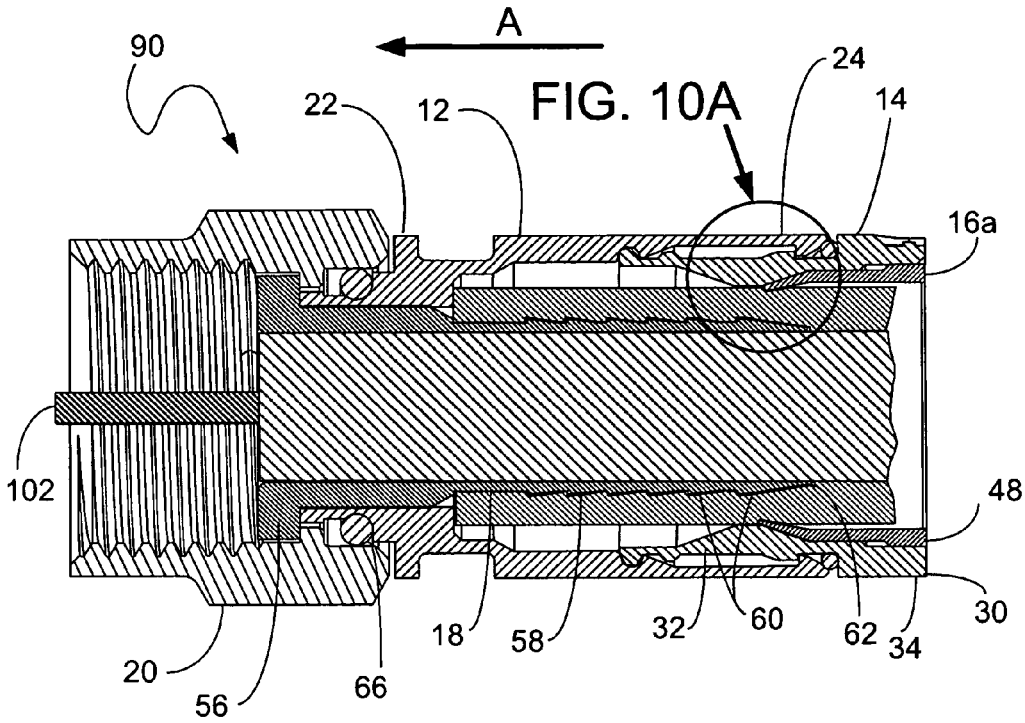
FIG. 10 is a cross-sectional view of the connector shown in FIG. 5 in its closed position.
Figure 10A:
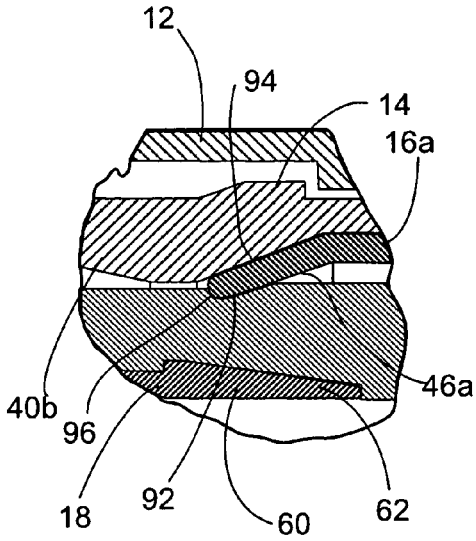
FIG. 10*a* is an enlarged detail view of the interaction between the inner sleeve ring and the locking sleeve ramp portion shown in FIG. 7.

FIGS. 9, 10 and 10A show another alternative embodiment of a connector 90 of the present invention, wherein the inner sleeve ring 16*a* itself directly provides a cable retention and sealing point on the cable 100. Again, the connector 90 shown in FIGS. 9, 10 and 10A is similar in most respects to the connector 10 described above with respect to FIGS. 1, 2 and 2A. Specifically, the connector 90 generally includes a connector body 12, a locking sleeve 14, an inner sleeve ring 16*a*, an annular post 18 and a rotatable nut 20, as described above.

However, in this embodiment, the forward end 46*a* of the inner sleeve ring 16*a* is modified slightly so as to directly engage the outer jacket 110 of the cable upon forward movement of the inner sleeve ring within the locking sleeve. Specifically, the forward end 46*a* of the inner sleeve ring 16*a* includes a deformable edge portion 92 which is adapted to compress or deflect radially inward toward the post barb 60 upon forward movement of the inner sleeve ring.

Also in this embodiment, the inner sleeve flange 40*b* is here formed with an internal ramp portion 94, which defines a transition region on the inner surface of the locking sleeve 14 between a first diameter and a smaller second diameter. As will be discussed further below, the internal ramp portion 94 of the sleeve flange 40*b* serves to radially compress the forward deformable edge portion 92 of the inner sleeve ring 16*a* upon forward insertion of the sleeve into the rearward end 30 of the locking sleeve 14.

More particularly, the deformable edge portion 92 is designed to expand radially inward when pressed against the internal ramp portion 94 of the sleeve flange 40*b*. This radially inward expansion of the deformable edge portion 92 will cause it to engage the outer surface of the cable 100 to secure the cable to the connector 70. In this regard, the deformable edge portion 92 of the inner sleeve ring 16*a* preferably terminates at a forward sharp edge 96 to enhance gripping of the cable jacket 110. The deformable edge portion 92 is preferably in the form of an annularly continuous deformable skirt. However, it is also conceivable that the deformable edge portion 92 can be formed with a plurality of circumferentially arranged flexible fingers (not shown) extending in the forward longitudinal direction, where water-resistant sealing against the cable is not required. The fingers may be formed simply by providing longitudinal slots or recesses in the forward end 46*a* of the inner sleeve ring 16*a*.

In use, a cable 100 is prepared and inserted into the connector 90, as described above, wherein the cable jacket 110 is parted from the cable insulator 104 by the sharp edge 62 of the post 18. The locking sleeve 18 is driven forward in the direction of arrow A from a first position, as shown in FIG. 9, to a second position, as shown in FIG. 10. Again, cooperating detent structure 27, 28, 29 can be provided between the connector body 12 and the locking sleeve 14, as described above, to positively lock the locking sleeve in its first and second positions. At the same time, or subsequently, the inner sleeve ring 16*a* is driven forward from a first position, as shown in FIG. 9, to a second position, as shown in FIG. 10. As the inner sleeve ring 16*a* is driven forward, the forward end 46*a* of the sleeve engages the internal ramp portion 94 of the sleeve flange 40*b* thereby causing the deformable edge portion 92 of the ring to deflect inwardly whereby its inner diameter is reduced and wherein the edge portion engages the outer jacket 110 of the cable 100. Thus, a cable retention and sealing point is established directly by the inner sleeve ring 16*a*.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

Various changes to the foregoing described and shown structures will now be evident to those skilled in the art. Accordingly, the particularly disclosed scope of the invention is set forth in the following claims.

What is claimed is:

1. A coaxial cable connector comprising:

a connector body having a rearward cable receiving end, a first engagement portion having a first internal diameter and a second engagement portion having a second internal diameter, said second internal diameter being smaller than said first internal diameter;

a locking sleeve movably coupled to said rearward cable receiving end of said connector body, said locking sleeve having a rearward sleeve ring receiving end;

a sleeve ring movably disposed within said rearward sleeve ring receiving end of said locking sleeve, said sleeve ring having a forward end adapted for retaining a cable within the connector upon forward insertion of said sleeve ring within said locking sleeve; and a cable gripping ferrule disposed in said first engagement portion of said connector body forward of said locking sleeve, said cable gripping ferrule being forced into said second engagement portion of said connector body upon forward insertion of said locking sleeve within said connector body, wherein said gripping ferrule compresses in a radially inward direction for engaging a cable inserted in the connector, wherein said cable gripping ferrule is an integral forward portion of said locking sleeve, said portion having at least one slot formed therein to facilitate said radially inward compression.

2. A coaxial cable connector as defined in claim 1, further comprising an annular post disposed within said connector body, said forward end of said sleeve ring urging the cable against said post upon forward insertion of said sleeve ring within said locking sleeve.

3. A coaxial cable connector as defined in claim 1, wherein said locking sleeve comprises a sleeve flange formed on an inner surface thereof, said sleeve flange including a flexible skirt, said forward end of said sleeve ring engaging said flexible skirt upon forward insertion of said sleeve ring within said locking sleeve to deflect said flexible skirt radially inward whereby said skirt engages the cable to retain the cable within the connector.

4. A coaxial cable connector as defined in claim 3, wherein an annular gap is formed between said flexible skirt and said inner surface of said locking sleeve, and wherein said forward end of said sleeve ring is formed with a forward facing ramp portion, said ramp portion being received in said annular gap and deflecting said flexible skirt radially inward upon forward insertion of said sleeve ring within said locking sleeve.

5. A coaxial cable connector as defined in claim 1, further comprising a cable engaging O-ring disposed within said locking sleeve, said forward end of said sleeve ring compressing said O-ring upon forward insertion of said sleeve ring within said locking sleeve to expand said O-ring radially inward whereby said O-ring engages the cable to seal the cable within the connector.

6. A coaxial cable connector as defined in claim 5, wherein said locking sleeve comprises a flange formed on an inner surface thereof, said flange having a rearward facing wall, said O-ring being compressed against said rearward facing wall by said forward end of said sleeve ring upon forward insertion of said sleeve ring within said locking sleeve.

7. A coaxial cable connector comprising:

a connector body including a rearward cable receiving end, a first engagement portion having a first internal diameter and a second engagement portion having a second internal diameter, said second internal diameter being smaller than said first internal diameter;

a locking sleeve movably coupled to said rearward cable receiving end of said connector body; and a cable gripping ferrule disposed in said first engagement portion of said connector body forward of said locking sleeve, said cable gripping ferrule being forced into said second engagement portion of said connector body upon forward insertion of said locking sleeve within said connector body, wherein said gripping ferrule compresses in a radially inward direction for engaging a cable inserted in the connector, wherein said cable gripping ferrule has a length, a first substantially constant outer diameter along its entire length when said gripping ferrule is disposed in said connector body first engagement portion and a second substantially constant outer diameter along its entire length when said gripping ferrule is disposed in said connector body second engagement portion, said second substantially constant outer diameter being smaller than said first substantially constant outer diameter.

8. A coaxial cable connector as defined in claim 7, further comprising a sleeve ring movably disposed within a rearward sleeve ring receiving end of said locking sleeve, said sleeve ring having a forward end adapted for retaining a cable within the connector upon forward insertion of said sleeve ring within said locking sleeve.

9. A coaxial cable connector as defined in claim 1, wherein said locking sleeve comprises a sleeve flange formed on an inner surface thereof, said sleeve flange including a ramped portion, and wherein said forward end of said sleeve ring includes a deformable edge portion, said deformable edge portion engaging said flange ramped portion upon forward insertion of said sleeve ring within said locking sleeve, whereby said deformable edge portion is deflected radially inward to engage the cable and retain the cable within the connector.

10. A coaxial cable connector as defined in claim 8, further comprising a cable engaging O-ring disposed within said locking sleeve, said forward end of said sleeve ring compressing said O-ring upon forward insertion of said sleeve ring within said locking sleeve to expand said O-ring radially inward whereby said O-ring engages the cable to seal the cable within the connector.

11. A coaxial cable connector as defined in claim 10, wherein said locking sleeve comprises a flange formed on an inner surface thereof, said flange having a rearward facing wall, said O-ring being compressed against said rearward facing wall by said forward end of said sleeve ring upon forward insertion of said sleeve ring within said locking sleeve.

12. A coaxial cable connector comprising:

a connector body including a rearward cable receiving end, a first engagement portion having a first internal diameter and a second engagement portion having a second internal diameter, said second internal diameter being smaller than said first internal diameter;

a locking sleeve movably coupled to said rearward cable receiving end of said connector body; and a cable gripping ferrule disposed in said first engagement portion of said connector body forward of said locking sleeve, said cable gripping ferrule being forced into said second engagement portion of said connector body upon forward insertion of said locking sleeve within said connector body, wherein said gripping ferrule compresses in a radially inward direction for engaging a cable inserted in the connector, wherein said cable gripping ferrule is an integral forward portion of said locking sleeve, said portion having at least one slot formed therein to facilitate said radially inward compression.

13. A coaxial cable connector as defined in claim 12, wherein said connector body further includes a ramp portion disposed between said first engagement portion and said second engagement portion, said ramp portion facilitating forward movement of said gripping ferrule from said first engagement portion into said second engagement portion.

14. A coaxial cable connector as defined in claim 7, wherein said cable gripping ferrule is a split ring formed separate from said locking sleeve, said ring having an outer diameter substantially equal to said first internal diameter of said connector body first engagement portion.

15. A method for terminating a coaxial cable in a connector comprising the steps of:

inserting an end of a cable into a rearward cable receiving end of a connector body;

axially moving a locking sleeve coupled to said connector body in a forward direction; and axially moving a sleeve ring within said locking sleeve in a forward direction, said sleeve ring having a forward end adapted for retaining a cable within the connector upon forward insertion of said sleeve ring within said locking sleeve, wherein said locking sleeve further comprises a forward cable gripping portion, said cable gripping portion being an integral forward portion of said locking sleeve and having at least one slot formed therein to facilitate said radially inward compression, and wherein said step of axially moving said locking sleeve comprises the step of compressing said forward cable gripping portion of said locking sleeve in a radially inward direction whereby said cable gripping portion engages the cable to retain the cable within the connector.

16. A method as defined in claim 15, wherein the connector further comprises an annular post disposed within said connector body, and wherein said step of axially moving said sleeve ring comprises the step of urging the cable with said forward end of said sleeve ring against said post.

17. A method as defined in claim 15, wherein said locking sleeve comprises a sleeve flange formed on an inner surface thereof, and said sleeve flange includes a flexible skirt, and wherein said step of axially moving said sleeve ring comprises the step of engaging said flexible skirt with said forward end of said sleeve ring to deflect said flexible skirt radially inward whereby said skirt engages the cable to retain the cable within the connector.

18. A method as defined in claim 15, wherein the connector further comprises a cable engaging O-ring disposed within said locking sleeve, and wherein said step of axially moving said sleeve ring comprises the step of compressing said O-ring with said forward end of said sleeve ring to expand said O-ring radially inward whereby said O-ring engages the cable to seal the cable within the connector.

19. A coaxial cable connector as defined in claim 8, wherein said locking sleeve comprises a sleeve flange formed on an inner surface thereof, said sleeve flange including a ramped portion, and wherein said forward end of said sleeve ring includes a deformable edge portion, said deformable edge portion engaging said flange ramped portion upon forward insertion of said sleeve ring within said locking sleeve, whereby said deformable edge portion is deflected radially inward to engage the cable and retain the cable within the connector.

20. A coaxial cable connector as defined in claim 8, wherein said locking sleeve comprises a sleeve flange formed on an inner surface thereof, said sleeve flange including a flexible skirt, said forward end of said sleeve ring engaging said flexible skirt upon forward insertion of said sleeve ring within said locking sleeve to deflect said flexible skirt radially inward whereby said skirt engages the cable to retain the cable within the connector.

21. A method as defined in claim 15, wherein said locking sleeve comprises a sleeve flange formed on an inner surface thereof, said sleeve flange including a ramped portion, and wherein said forward end of said sleeve ring includes a deformable edge portion, said deformable edge portion engaging said flange ramped portion upon forward insertion of said sleeve ring within said locking sleeve, wherein said deformable edge portion is deflected radially inward to engage the cable and retain the cable within the connector.

22. A coaxial cable connector as defined in claim 7, wherein said cable gripping ferrule is an integral forward portion of said locking sleeve, said portion having at least one slot formed therein to facilitate said radially inward compression.

23. A coaxial cable connector as defined in claim 8, further comprising an annular post disposed within said connector body, said forward end of said sleeve ring urging the cable against said post upon forward insertion of said sleeve ring within said locking sleeve.

24. A coaxial cable connector as defined in claim 20, wherein an annular gap is formed between said flexible skirt and said inner surface of said locking sleeve, and wherein said forward end of said sleeve ring is formed with a forward facing ramp portion, said ramp portion being received in said annular gap and deflecting said flexible skirt radially inward upon forward insertion of said sleeve ring within said locking sleeve.

* * * * *